US009382632B2

(12) United States Patent
Garcia-Diaz et al.

(10) Patent No.: US 9,382,632 B2
(45) Date of Patent: Jul. 5, 2016

(54) ELECTROCHEMICAL FLUORINATION FOR PROCESSING OF USED NUCLEAR FUEL

(71) Applicant: Savannah River Nuclear Solutions, LLC, Aiken, SC (US)

(72) Inventors: Brenda L. Garcia-Diaz, Aiken, SC (US); Michael J. Martinez-Rodriguez, Aiken, SC (US); Joshua R. Gray, Aiken, SC (US); Luke C. Olson, North Augusta, SC (US)

(73) Assignee: Savannah River Nuclear Solutions, LLC, Aiken, SC (US)

( * ) Notice: Subject to any disclaimer, the term of this patent is extended or adjusted under 35 U.S.C. 154(b) by 128 days.

(21) Appl. No.: 14/312,098

(22) Filed: Jun. 23, 2014

(65) Prior Publication Data

US 2014/0374272 A1 Dec. 25, 2014

Related U.S. Application Data

(60) Provisional application No. 61/838,003, filed on Jun. 21, 2013.

(51) Int. Cl.

| | |
|---|---|
| ***C25B 1/24*** | (2006.01) |
| ***C25B 15/08*** | (2006.01) |
| ***C25B 15/02*** | (2006.01) |

(52) U.S. Cl.

CPC ..... *C25B 1/245* (2013.01); *C25B 15/02* (2013.01); *C25B 15/08* (2013.01)

(58) Field of Classification Search

CPC ..... C25B 1/245; C25B 15/08; C22B 60/02; C22B 60/0204; C22B 60/0286

USPC ..... 205/359, 49

See application file for complete search history.

(56) References Cited

U.S. PATENT DOCUMENTS

| | | | |
|---|---|---|---|
| 2,830,873 | A | 4/1958 | Katz et al. |
| 2,951,793 | A | 9/1960 | Hansen |
| 3,275,442 | A | 9/1966 | Kosenkranius |
| 3,294,483 | A | 12/1966 | Hirchberg |
| 3,359,078 | A | 12/1967 | Alter et al. |
| 3,878,060 | A | 4/1975 | Kroebel |
| 4,001,039 | A | 1/1977 | Elmore et al. |
| 4,011,296 | A | 3/1977 | Ruiz et al. |
| 4,227,988 | A | 10/1980 | Galwey et al. |
| 4,521,281 | A | 6/1985 | Kadija |

(Continued)

FOREIGN PATENT DOCUMENTS

WO WO 2011/144937 11/2011

OTHER PUBLICATIONS

"Spent Nuclear Fuel Reprocessing Flowsheet" by the NEA Nuclear Science Committee, 2012 (15).

*Primary Examiner* — Bryan D. Ripa

(74) *Attorney, Agent, or Firm* — Dority & Manning, PA

(57) ABSTRACT

A galvanic cell and methods of using the galvanic cell is described for the recovery of uranium from used nuclear fuel according to an electrofluorination process. The galvanic cell requires no input energy and can utilize relatively benign gaseous fluorinating agents. Uranium can be recovered from used nuclear fuel in the form of gaseous uranium compound such as uranium hexafluoride, which can then be converted to metallic uranium or $UO_2$ and processed according to known methodology to form a useful product, e.g., fuel pellets for use in a commercial energy production system.

13 Claims, 1 Drawing Sheet

(56) References Cited

U.S. PATENT DOCUMENTS

| | | | | |
|---|---|---|---|---|
| 4,596,647 | A | 6/1986 | Miller et al. | |
| 4,855,030 | A | 8/1989 | Miller | |
| 4,880,506 | A * | 11/1989 | Ackerman | C25C 3/34 204/225 |
| 4,995,948 | A | 2/1991 | Poa et al. | |
| 5,009,752 | A | 4/1991 | Tomczuk et al. | |
| 5,340,447 | A | 8/1994 | Bertaud et al. | |
| 5,356,605 | A | 10/1994 | Tomczuk et al. | |
| 5,380,406 | A | 1/1995 | Horton et al. | |
| 6,299,748 | B1 | 10/2001 | Kondo et al. | |
| 6,736,951 | B2 | 5/2004 | Kondo et al. | |
| 6,818,105 | B2 | 11/2004 | Tojo et al. | |
| 7,172,741 | B2 | 2/2007 | Kawamura et al. | |
| 7,267,754 | B1 * | 9/2007 | Willit | C25C 3/34 205/46 |
| 7,445,760 | B2 | 11/2008 | Fukasawa et al. | |
| 7,638,026 | B1 * | 12/2009 | Willit | C25C 3/34 204/243.1 |
| 8,293,428 | B2 | 10/2012 | Yamamoto et al. | |
| 8,747,786 | B2 | 6/2014 | Visser et al. | |
| 9,039,885 | B1 * | 5/2015 | Holland | C25B 1/24 204/246 |
| 2005/0139474 | A1 | 6/2005 | Lewin et al. | |
| 2010/0126874 | A1 * | 5/2010 | Watanabe | C25C 3/34 205/354 |

* cited by examiner

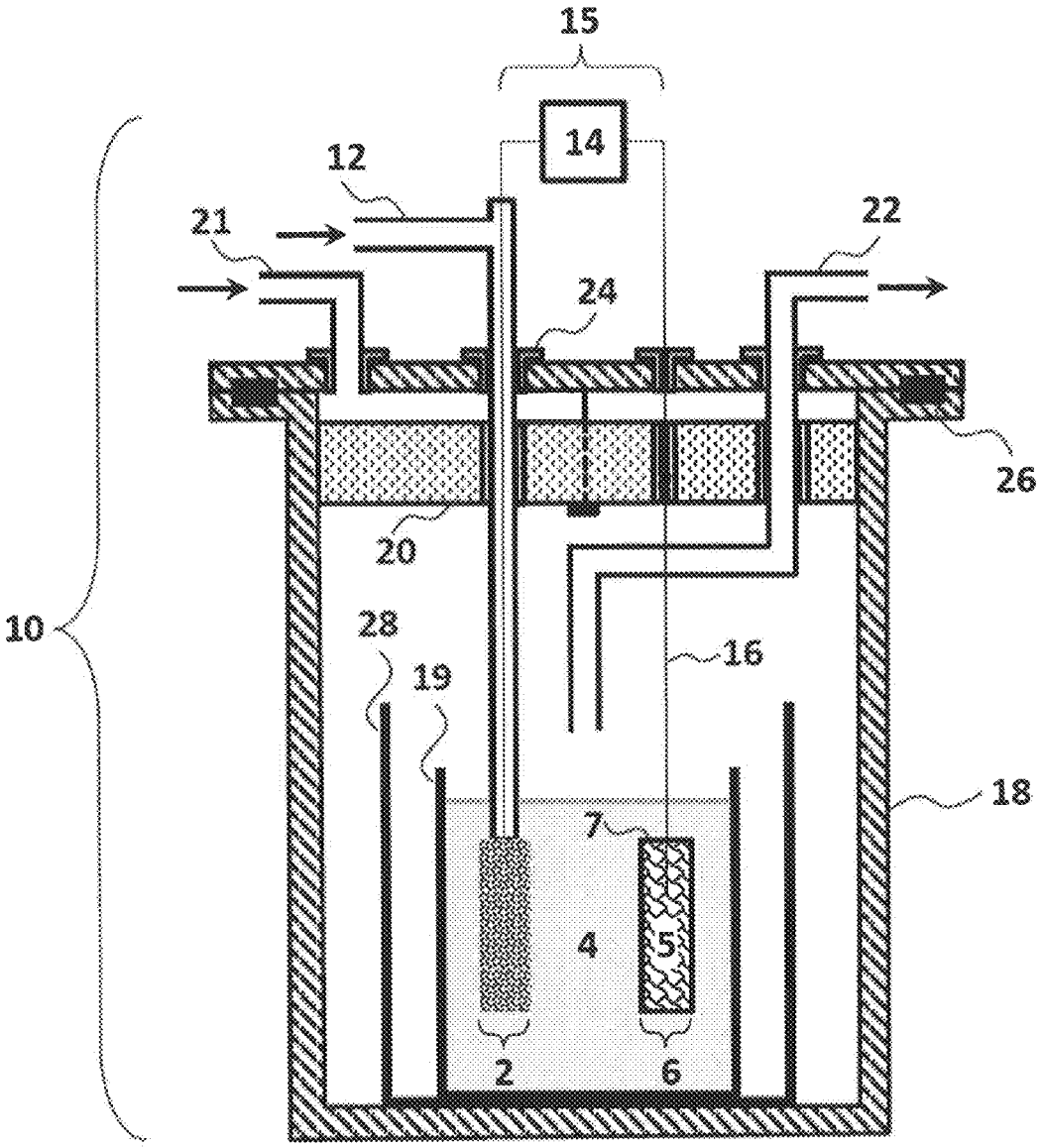
15
14
12
21
22
24
26
20
10
28
19
16
18
7
4
5
2
6

ELECTROCHEMICAL FLUORINATION FOR PROCESSING OF USED NUCLEAR FUEL

CROSS REFERENCE TO RELATED APPLICATION

This application claims the benefit of priority of U.S. Provisional Patent Application No. 61/838,003 entitled Electrochemical Fluorination for Processing of Used Nuclear Fuel, filed Jun. 21, 2013, which is incorporated herein by reference for all purposes.

STATEMENT AS TO RIGHTS TO INVENTIONS MADE UNDER FEDERALLY SPONSORED RESEARCH

This invention was made with Government support under Contract No. DE-AC09-08SR22470 awarded by the United States Department of Energy. The Government has certain rights in the invention.

BACKGROUND

Electrorefining is an electrolytic process that has been used to recover high purity metals (e.g., uranium) from the mixture of elements in used nuclear fuel, also known as spent nuclear fuel. Electrorefining is an electrolytic process carried out in an electrolysis cell in which the impure feed is the anode and the electrolyte is a molten salt of the metal or metals to be recovered mixed with one or more alkali metal salts, with the purified metal being recovered at a metal cathode. The electrorefining process can be used along with electrowinning steps that utilize an additional liquid metal cathode in which metal ions dissolved in the electrolyte are reduced to form an intermetallic with the targeted metal.

Methods based upon fluoride volatility have also been utilized to recover metals from used nuclear fuel. According to this process, metals or metal oxides in the used nuclear fuel are reacted with a fluorinating agent. The fluorinating agent converts the feed materials to a mixture of fluorides, some of which are volatile. The volatile fluorides can then be separated from the remainder of the material and then further separated from each other via adsorption, desublimation, distillation, etc. This method has also been utilized to remove nuclear fuel components from a mixture of molten salts.

U.S. Pat. No. 5,340,447 to Bertaud, et al. describes a process for the selective electrofluorination of a metallic alloy in which a controlled voltage is applied to the alloy. The electrolyte is a mixture of molten fluorides and hydrofluoric acid and a power supply applies a potential to a uranium electrode to selectively oxidate uranium to form volatile $UF_6$. Such systems require energy input and close control of the input currents to maintain the targeted applied voltage across the cell.

What are needed in the art are methods and systems that can selectively recover targeted metals such as uranium from a mixture of components found in used nuclear fuel.

SUMMARY

Aspects and advantages of the invention will be set forth in part in the following description, or may be obvious from the description, or may be learned through practice of the invention.

In one embodiment, disclosed is a galvanic cell for use in recovery of uranium from used nuclear fuel. The galvanic cell can include an inlet for a fluorine-containing gas, an electrolyte, a gas diffusion cathode, a container for containing an anode that includes the used nuclear fuel, an outlet for a gaseous uranium compound formed at the anode, and an electronic load control element in a circuit that includes the cathode and the anode. More specifically, the fluorine-containing gas is reducible to form fluoride ions and, optionally, an electrochemically inert reduction product; the electrolyte includes a fluoride salt that is molten during operation of the cell; and the gas diffusion cathode allows three phase contact between an electrically conductive matrix material of the cathode, the electrolyte, and the fluorine-containing gas.

Also disclosed is a method for recovering uranium from used nuclear fuel. The method can include, for instance, distributing a fluorine-containing gas, also referred to throughout this disclosure as a gaseous fluorinating agent, through a gas diffusion cathode of a galvanic cell such that three phase contact occurs between the fluorine-containing gas, an electrically conductive cathode matrix material, and an electrolyte that includes a molten fluoride salt, the molten fluoride salt conducting fluoride ions formed at the gas diffusion cathode upon reduction of the fluorine-containing gas. The method also includes closing a circuit that includes the cathode, an anode, and an electronic load control element; and collecting a gaseous uranium compound that is formed at the anode via oxidation of uranium that is in used nuclear fuel of the anode.

These and other features, aspects and advantages of the present disclosure will become better understood with reference to the following description and appended claims.

BRIEF DESCRIPTION OF THE FIGURES

A full and enabling disclosure of the present invention, including the best mode thereof, directed to one of ordinary skill in the art, is set forth in the specification, which makes reference to the appended figure, in which:

FIG. 1 schematically illustrates one embodiment of a galvanic cell as described herein.

DETAILED DESCRIPTION

It is to be understood by one of ordinary skill in the art that the present discussion is a description of exemplary embodiments only, and is not intended as limiting the broader aspects of the present disclosure. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

The present disclosure is generally directed to a galvanic cell and methods of using the galvanic cell. More specifically, the galvanic cell can be utilized for the recovery of uranium from used nuclear fuel according to an electrofluorination process. Beneficially, as the cell is a galvanic cell, no input energy is required to encourage chemical reactions at the electrodes. Moreover, the galvanic cell can utilize relatively benign gaseous fluorinating agents, such as nitrogen trifluoride ($NF_3$) or xenon difluoride ($XeF_2$), rather than the more dangerous hydrofluoric acid as has been utilized in previously known electrolytic cells. The uranium can be recovered from the cell as gaseous uranium hexafluoride and/or other gaseous uranium compounds, which can then be converted to metallic uranium or $UO_2$ and processed according to known methodology to form a useful product, e.g., fuel pellets for use in a commercial energy production system as well as other applications such desulfurization, selective reduction of nitrogen oxide, and various applications involving reaction with organic compounds.

One embodiment of a galvanic cell 10 is illustrated in FIG. 1. In general, the galvanic cell can include a cathode 2, an electrolyte 4, and an anode 6 in electrical communication with one another via a circuit 15. More specifically, the anode 6 can include used nuclear fuel 5 to be processed by the galvanic cell.

The used nuclear fuel before pre-processing can either be in the metallic or oxide state. The used nuclear fuel 5 can be pre-processed according to known methodology. For instance, the used nuclear fuel can be chopped or ground to increase the surface area of the used nuclear fuel 5. Accordingly, as the used nuclear fuel 5 can be provided to the galvanic cell 10 as a chopped or ground feedstock, it can be beneficial to contain the used nuclear fuel 5 within a container 7, which can be, for example, a basket or other suitable container 7. The used nuclear fuel 5 can be preprocessed according to other processing techniques as are known in the art such as high temperature treatments including voloxidation that can be utilized to capture tritium, iodine, technetium, etc. If the fuel is an oxide or if an oxidizing treatment was/is performed, then the fuel should be chemically or electrochemically reduced to a metallic state as part of the pre-processing step before electrochemical fluorination. The used nuclear feed to the galvanic electrochemical process can be an alloy of fission product metals that contains a large portion of uranium metal mixed with other fission products in the metallic state. The pre-processing steps may remove all or part of specific fission products. It should be understood, however, that this disclosure applies to any alloy composition that can result from any combination of pre-processing steps.

The container 7 can be formed of any suitable material that is resistant to the components of the galvanic cell (e.g., the molten salts of the electrolyte) and that can provide access for fluoride ions from the electrolyte to the used nuclear fuel 5 held in the container 7. For instance, the container 7 can be formed of a corrosion resistant material including carbon compounds such as graphite or glassy carbon, ceramics such as silicon carbide or boron nitride, a corrosion resistant metal alloy, or composite material including carbon and ceramics, or a perfluorinated plastic material, such as a polyfluoroethylene, provided the material can withstand the operating temperatures of the galvanic cell. In one embodiment, the container 7 can be formed of a glassy carbon material. In general, any metal of the container 7 can be insulated from the used nuclear fuel 5 held within the container 7, for instance by inclusion of an insulative covering on at least that portion of a metal or metal alloy of the container 7 that would otherwise contact the used nuclear fuel 5. In one embodiment, the used nuclear fuel 5 may be fully or partially fluidized within the anode.

The electrolyte 4 includes one or more fluoride salts that can be held in the form of a molten salt electrolyte bath during operation of the galvanic cell 10. Fluoride salts encompassed in the electrolyte can include, without limitation, potassium fluoride (KF), ammonium fluoride ($NH_4F$), sodium fluoride (NaF), rubidium fluoride (RbF), magnesium fluoride ($MgF_2$), calcium fluoride ($CaF_2$), lithium fluoride (LiF), strontium fluoride ($SrF_2$), chromium fluoride ($CrF_2$ and/or $CrF_3$), and iron fluoride ($FeF_2$ and/or $FeF_3$) as well as mixtures of fluoride salts. The electrolyte may optionally include additional salts, such as chloride salts in addition to the fluoride salts.

The cathode 2 of the galvanic cell 10 can be a gas diffusion cathode. The gas diffusion cathode 2 allows for three phase contact between the electrolyte, an electrically conductive matrix material of the cathode 2, and a gaseous fluorinating agent. Ideally, the three phase contact between the components can have maximum charge transfer efficiency. Gas diffusion electrodes and materials for such electrodes as are generally known in the art may be utilized in forming the gas diffusion cathode 2. For instance, U.S. Pat. No. 4,001,039 to Elmore, et al., U.S. Pat. No. 4,521,281 to Kadija, and U.S. Pat. No. 8,293,428 to Yamamoto, et al., all of which are incorporated herein by reference, describe gas diffusion electrodes and materials for such electrodes as may be utilized in the galvanic cell 10 at the gas diffusion cathode 2.

The gas diffusion cathode 2 can include an electrically conductive matrix material that can be capable of use while submerged in the molten salt electrolyte 4. Examples of electrically conductive matrix materials from which the cathode 2 can be formed include, without limitation, metallic materials based on nickel, tungsten, molybedenum, and cobalt as well as carbon based materials such as glassy carbon and graphite. Alloys including refractory metals such as niobium, molybdenum, tantalum, tungsten, and rhenium as well as conductive ceramics and composite materials can also be utilized in forming the cathode 2. In one embodiment, the gas diffusion cathode 2 can include a metallic material in powder form that can function as the electrically conductive matrix material. In this embodiment, the electrically conductive matrix material can be porous and during use the gaseous fluorinating agent can pass through the porous electrically conductive matrix material. In one embodiment, the cathode 2 can include conductive powders of different sizes, for instance a portion of the cathode 2 can be formed of a coarse conductive powder and a portion of the cathode 2 can be formed of a finer conductive powder such that pores of the cathode 2 can have variable cross-sectional areas.

The gas diffusion cathode can include non-conductive materials in conjunction with an electrically conductive matrix material. For example, in one embodiment, a porous portion of the cathode can be formed of a non-conductive material, such as non-conductive ceramic or a non-conductive polymeric material (e.g., a non-conductive porous structure including a perfluorinated polymer). The non-conductive porous portion of the cathode 2 can deliver the gaseous fluorinating agent to the electrolyte 4. In addition, the non-conductive porous portion of the cathode 2 can be associated with the electrically conductive matrix material such that three phase contact occurs at delivery of the gaseous fluorinating agent to the electrolyte. For example, the porous portion of the cathode 2 can be adjacent to or otherwise held in conjunction with the electrically conductive matrix material such that the three phase contact occurs.

As an illustrative example of a gas diffusion cathode, a metal powder can be mixed with a porous glassy carbon material, and the mixture can be adhered to a metal substrate of the same or different metal as the metal powder. The metal can be any suitable metal for the electrically conductive matrix material, e.g., nickel or cobalt-based alloys, steel, tungsten, molybdenum, etc. The mixture can then be heated at a temperature to remove any additives (e.g., dispersion agents) but such that an open porous structure of the polymer-metal mixture is maintained.

The gas diffusion cathode 2 can include a plurality of pores that extend across at least a portion of the cathode for delivery of the fluorinating agent. For instance, the portion of the cathode that is porous can have a void fraction of from about 5% to about 90%, from about 10% to about 80%, or from about 20% to about 70%.

During operation of the cell 10, the gaseous fluorinating agent can enter the cathode 2 through a delivery line 12. From the delivery line 12, the gaseous fluorinating agent can enter the porous portion of the gas diffusion cathode 2. The pores of the gas diffusion cathode are in communication with the electrolyte 4. The porous portion of the gas diffusion cathode 2 is also held in conjunction with the electrically conductive matrix material of the cathode 2. Thus, as the gaseous fluorinating agent diffuses through the pores of the cathode 2 and contacts the electrically conductive matrix material and the electrolyte in three phase contact it is reduced to form fluoride ions.

As fluorinating agent, any gaseous agent is encompassed that upon reduction at the cathode will form fluoride ions and, in those embodiments in which a second reduction product is formed, any secondary reduction products will be electrochemically inert. The term 'electrochemically inert' refers to a reduction product that will not be further reduced in the galvanic cell.

In addition, the fluorinating agent will have a reduction potential that is greater than the reduction potential of the uranium compound formation that takes place at the anode. In one embodiment, the fluorinating agent can have a reduction potential that is about 2 volts or more greater than the reduction potential of the uranium compound formation reaction at the anode.

The fluorinating agent can be $NF_3$, which upon reduction forms fluoride ions and electrochemically inert nitrogen gas. Another example of a fluorinating agent is $XeF_2$, which upon reduction forms fluoride ions and electrochemically inert xenon gas. In one embodiment, the fluorinating agent can be fluorine gas, $F_2$, which can be completely consumed at the reduction. Other fluorinating agents can include, without limitation, bromine trifluoride ($BrF_3$), phosphorous trifluoride ($PF_3$), boron trifluoride ($BF_3$), and the like. In any case, the reduction products of the gaseous fluorinating agent will not include as reduction product cations that will be further reduced in the cell as is the case for hydrofluoric acid fluorinating agents utilized in previously known electrolytic cells.

The cathode 2 and anode 6 of the galvanic cell 10 are in electrical communication with one another via a circuit 15. The circuit 15 also includes an electronic load control element 14. Electronic load control element 14 can be any suitable element that can vary the electrical load across the cell. For instance, the load control element 14 can be a potentiostat, a potentiometer, a variable resistor, a static resistor, etc. that dissipates the electrical load across the galvanic cell.

The load across the cell can be defined by the chemical reactions at the cathode and the anode. More specifically, the reduction potential of the gaseous fluorinating agent at the cathode can be greater than the reduction potential for the formation of the gaseous uranium compound, e.g., uranium hexafluoride, at the anode. By way of example, and without limitation, the open circuit voltage at the cathode can be about 0.5 volts or more greater than the open circuit voltage at the anode, or about 1 volt or more greater that the open circuit voltage at the anode. Of course, the kinetic losses and ohmic losses that will occur during operation of a device can affect the voltage across the cell, as can the specific cell design, configuration, electrode material, fluorinating agent, intermediates, etc., as is known.

In one embodiment, the electronic load control element can be a potentiostat as is generally known in the art. In general, a potentiostat can include an operational amplifier in a feedback control configuration in which the potential of a reference electrode is controlled relative to the cell's working electrode. The potentiostat can also include control mechanisms as are known in the art to prevent damage to the cell components should the preset reference voltage become substantially different from the input voltage across the cell. During use, the potentiostat can measure and maintain a voltage across the cell as the uranium is oxidized to, e.g., uranium hexafluoride at the anode. U.S. Pat. No. 4,227,988 to Galwey, et al. which is incorporated by reference, describes one embodiment of a potentiostat as may be incorporated in the galvanic cell.

Referring again to FIG. 1, the circuit 15 can include a lead 16 that can provide an electrical connection from the used nuclear fuel 5 of the anode 6 to the electronic load control element 14 of the circuit 15. For instance, the lead 16 can be a carbon, metal, or other conductive element that can be in electrical contact with the used nuclear fuel. In the illustrated embodiment of FIG. 1, the lead 16 is submerged in the used nuclear fuel 5, but this is not a requirement of the galvanic cell 10, and any suitable arrangement that provides an electrical connection between the used nuclear fuel 5 of the anode 6 and the electronic load control element 14 may alternatively be utilized.

The galvanic cell 10 can include a surrounding tank 18 that can be formed of any suitable insulative or conductive material and in any suitable configuration. For example, the tank 18 can be formed of a coated steel or other metallic material or a polymeric material that can withstand the operating conditions and components of the system. Temperature control elements such as coils, etc. (not shown in FIG. 1) can be associated with the tank 18 to control the temperature of the electrolyte 4, as is known. The temperature of the galvanic cell during operation can be from about 300° C. to about 1000° C., or from about 300° C. to about 800° C., in one embodiment.

The surrounding tank 18 also includes a cover or lid that can enclose the area above the used nuclear fuel 5 of the anode 6. The cover can be formed of the same materials as are utilized in forming the tank 18 or alternative materials, as desired. For instance, the cover can be formed of an insulative or a conductive material. The lid can have penetrations 24 made using fittings, weldments, or another suitable method. The penetrations and materials in contact with the penetrations may be electrically conducting or electrically insulating as is suitable. In one embodiment, the cover can be formed of the same material as is utilized in forming the container 7. in one embodiment, the lid may have an extension 20 for the purpose of affecting gas flow or heat flow within the tank. This extension can also have penetrations for various elements being passed in and out of the cell.

The electrolyte 4 can be directly in contact with the tank or may be isolated inside one or more internal containers 19 and 28 such as is known in the art. These inner containers may serve a variety of design purposes including but not limited to secondary containment, thermal insulation, material compatibility, corrosion prevention, electrical conduction, or electrical insulation.

The galvanic cell 10 can also include an inert gas inlet 21 and an outlet 22 through which the gaseous uranium compound that is formed upon oxidation of the uranium in the used nuclear fuel 5 and any inert gas exit the cell. The gaseous uranium compound can be gathered for further treatment.

The tank and lid may include gaskets 26 or other elements to isolate the environment inside the cell from the outside environment. The gaskets or other isolation element can be formed from any suitable material for the operating conditions or components of the system.

The uranium compound formed at the anode of the galvanic cell can be subjected to reenrichment processes or mixing with similar uranium compounds to change the ratio of isotopes in the uranium compound. This processed uranium compound can be converted to metallic uranium in pellets, ingots, or other forms and in one particular embodiment, uranium as may be utilized as a fuel. The processed uranium compound can also be mixed with other metallic species to form a mixture of metals or alloy. In one embodiment, the other metallic species can be other metallic fission products including but not limited to actinides such as Plutonium, Neptunium, Americium, and Curium. In a particular embodiment, this mixture of metals including the processed anode uranium compound could be used as fuel.

The uranium compound formed at the anode of the galvanic cell can be converted to form particles comprising uranium oxide and in one particular embodiment, uranium dioxide as may be utilized as a fuel. For example, in one embodiment, gaseous uranium hexafluoride can be hydrolyzed by solution in water. Following, ammonia can be added to precipitate ammonium diuranate, and the ammonium diuranate can be utilized as feedstock according to the process described in co-owned U.S. patent application Ser. No. 13/606,558 having a filing date of Sep. 7, 2012, which is incorporated herein by reference. Briefly, according to this process, the uranium-containing feedstock can be combined with an ionic liquid to form a basic mixture (e.g., a pH greater than about 8). The ionic liquid can be an organic salt that is formed of anionic and cationic species and has a melting point of about 100° C. or less. The mixture thus formed can then be heated to a temperature of from about 100° C. to about 300° C. and held at this elevated temperature for a time (e.g., greater than about 12 hours) to form nanoparticles including uranium oxide.

According to another process, the gaseous uranium hexafluoride can be combined with carbon dioxide and ammonia in water to precipitate ammonium uranyl carbonate, which can then be utilized as a feedstock according to the process described in the co-owned application previously incorporated herein by reference. Of course other processing methods can alternatively be utilized to process the uranium compound.

The uranium oxide thus formed can then be processed according to known methodology including pressing, sintering, and shaping, for instance to form fuel pellets.

Fluorinated fission products present at the anode or in the electrolyte after full or partial electrochemical fluorination of the anode 6 may be further processed by electrochemical, chemical, or physical processes to isolate specific components. In one embodiment, all or part of the fluorinated fission products could be electrochemically reduced in a liquid metal electrode and in a specific embodiment, the elements reduced by this method could be distilled and used as a component in fuel.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method for recovering uranium from used nuclear fuel, the method comprising:

distributing a fluorine-containing gas through a gas diffusion cathode of a galvanic cell such that three phase contact occurs between the fluorine-containing gas, an electrically conductive matrix material of the gas diffusion cathode, and an electrolyte, the electrolyte comprising a molten fluoride salt, the electrolyte conducting fluoride ions formed upon reduction of the fluorine-containing gas at the gas diffusion cathode;

closing a circuit, the circuit including the gas diffusion cathode, an anode, and an electronic load control element; and collecting a gaseous uranium compound that is formed at the anode, the anode including metallic used nuclear fuel, the used nuclear fuel including uranium and the uranium being oxidized at the anode to form the gaseous uranium compound.

2. The method of claim 1, wherein the used nuclear fuel is an alloy including the uranium.

3. The method of claim 1, wherein the gaseous uranium pound that is formed at the anode comprises uranium hexafluoride.

4. The method of claim 1, wherein the fluorine-containing gas comprises nitrogen trifluoride or xenon difluoride.

5. The method of claim 1, wherein the molten fluoride salt comprises lithium fluoride, potassium fluoride, sodium fluoride, iron fluoride, chromium fluoride, rubidium fluoride, magnesium fluoride, calcium fluoride, strontium fluoride, ammonium fluoride, or mixtures thereof.

6. The method of claim 1, the molten fluoride salt further comprising a chloride salt.

7. The method of claim 1, wherein an electrochemically inert reduction product is formed upon reduction of the fluoride gas at the gas diffusion cathode.

8. The method of claim 1, wherein the electronic load control element is a potentiostat, a potentiometer, a variable resistor, or a static resistor.

9. The method of claim 1, wherein the fluoride gas has a reduction potential that is about 2 volts or more greater than the reduction potential of the gaseous uranium compound formation reaction.

10. The method of claim 1, wherein the open circuit voltage at the gas diffusion cathode is about 0.5 volts or more greater than the open circuit voltage at the anode.

11. The method of claim 1, wherein the electronic load control element measures and maintains a voltage across the galvanic cell as the uranium is oxidized at the anode.

12. The method of claim 1, further comprising converting the gaseous uranium compound to form uranium oxide.

13. The method of claim 1, wherein the temperature of the galvanic cell during formation of the gaseous uranium compound at the anode is from about 300° C. to about 1000° C.

* * * * *